US009618184B2

(12) United States Patent
Buchholz et al.

(10) Patent No.: US 9,618,184 B2
(45) Date of Patent: Apr. 11, 2017

(54) ALARM WITH REFLECTOR RING

(71) Applicant: Walter Kidde Portable Equipment Inc., Mebane, NC (US)

(72) Inventors: Matthew J. Buchholz, Canon City, CO (US); Ken Mott, Colorado Springs, CO (US); Dave Bush, Wheatland, WY (US)

(73) Assignee: WALTER KIDDE PORTABLE EQUIPMENT INC., Mebane, NC (US)

( * ) Notice: Subject to any disclaimer, the term of this patent is extended or adjusted under 35 U.S.C. 154(b) by 148 days.

(21) Appl. No.: 14/209,032

(22) Filed: Mar. 13, 2014

(65) Prior Publication Data

US 2014/0268753 A1 Sep. 18, 2014

Related U.S. Application Data

(60) Provisional application No. 61/793,337, filed on Mar. 15, 2013.

(51) Int. Cl.

| | |
|---|---|
| ***F21V 7/04*** | (2006.01) |
| ***G08B 5/36*** | (2006.01) |
| ***F21V 7/00*** | (2006.01) |
| ***F21V 33/00*** | (2006.01) |
| *F21Y 101/00* | (2016.01) |
| *F21Y 103/33* | (2016.01) |

(52) U.S. Cl.

CPC ..... *F21V 7/0066* (2013.01); *F21V 7/041* (2013.01); *F21V 33/0076* (2013.01); *F21V 7/0083* (2013.01); *F21Y 2101/00* (2013.01); *F21Y 2103/33* (2016.08); *G08B 5/36* (2013.01)

(58) Field of Classification Search

CPC .... F21V 7/0041; F21V 7/0058; F21V 7/0066; F21V 33/0076; F21V 14/02; F21V 14/025; F21V 7/041; F21V 7/0083; F21Y 2101/02; F21Y 2103/022; F21Y 2105/005; F21Y 2111/007; G08B 5/36

See application file for complete search history.

(56) References Cited

U.S. PATENT DOCUMENTS

| | | | | |
|---|---|---|---|---|
| 4,654,629 | A * | 3/1987 | Bezos | B60Q 1/2696 246/473.3 |
| 5,567,036 | A * | 10/1996 | Theobald | B60Q 1/2607 362/236 |
| 5,602,522 | A | 2/1997 | Pacelli | |
| 5,642,933 | A | 7/1997 | Hitora | |
| 5,929,788 | A | 7/1999 | Vukosic | |
| 6,241,373 | B1 * | 6/2001 | Kelley | B60Q 1/32 362/184 |

(Continued)

*Primary Examiner* — Alan Cariaso
(74) *Attorney, Agent, or Firm* — Cantor Colburn LLP

(57) ABSTRACT

An indicator assembly for a visual life safety alarm is provided including a hollow, generally frustoconical reflector ring having an angled wall. The reflector ring is mounted to a housing of the visual life safety alarm at a first end. A first plurality of light devices is mounted to the housing within a first opening of the first end of the reflector ring. Light from the first plurality of light devices is configured to emit in a generally forwards direction. A second plurality of light devices is mounted to the housing near the angled wall of the reflector ring, opposite the first plurality of light devices. Light from the second plurality of light devices is configured to reflect from the angled wall in a direction generally angled from the visual safety alarm.

11 Claims, 9 Drawing Sheets

(56) References Cited

U.S. PATENT DOCUMENTS

| | | | | |
|---|---|---|---|---|
| 6,243,001 | B1 | 6/2001 | Kodaka | |
| 6,549,121 | B2 | 4/2003 | Povey et al. | |
| 6,626,557 | B1 | 9/2003 | Taylor | |
| 6,679,618 | B1 | 1/2004 | Suckow et al. | |
| 6,914,534 | B2 | 7/2005 | Tanguay | |
| 7,023,353 | B2 | 4/2006 | Tewell et al. | |
| 7,465,065 | B2 * | 12/2008 | Marka | F21S 2/005 362/232 |
| 7,623,026 | B2 | 11/2009 | Martin, Jr. et al. | |
| 7,636,049 | B2 | 12/2009 | Ellul, Jr. | |
| 7,665,866 | B2 | 2/2010 | Mayer et al. | |
| 7,746,009 | B2 * | 6/2010 | Held | F21V 23/04 315/362 |
| 7,832,908 | B2 | 11/2010 | Peck et al. | |
| 7,920,053 | B2 | 4/2011 | Pattok et al. | |
| 8,025,428 | B2 * | 9/2011 | Duguay | F21S 8/086 362/249.02 |
| 8,026,829 | B2 | 9/2011 | Curran et al. | |
| 8,240,880 | B2 | 8/2012 | Chen et al. | |
| 8,282,237 | B2 | 10/2012 | Vittozzi | |
| 8,353,607 | B2 | 1/2013 | Goncalves et al. | |
| 8,501,509 | B2 * | 8/2013 | Mondada | H01L 25/0753 257/88 |
| 8,840,269 | B2 * | 9/2014 | Kang | F21K 9/135 362/236 |
| 9,016,896 | B1 * | 4/2015 | Roudeski | F21V 7/04 340/953 |
| 2011/0002116 | A1 | 1/2011 | Chen et al. | |
| 2011/0013413 | A1 * | 1/2011 | Yang | F21K 9/135 362/545 |
| 2012/0287636 | A1 * | 11/2012 | Chen | F21K 9/135 362/249.02 |
| 2012/0300449 | A1 | 11/2012 | Fields | |
| 2014/0016316 | A1 * | 1/2014 | Hsin | F21K 9/135 362/240 |
| 2014/0098568 | A1 * | 4/2014 | Taylor | F21V 3/0436 362/650 |

* cited by examiner

ALARM WITH REFLECTOR RING

CROSS-REFERENCE TO RELATED APPLICATIONS

This application claims the benefit of U.S. provisional patent application Ser. No. 61/793,337 filed Mar. 15, 2013, the entire contents of which are incorporated herein by reference.

BACKGROUND OF THE INVENTION

The invention relates generally to alarm systems that indicate smoke, fire, carbon monoxide, and/or other conditions, and more particularly, to an alarm systems used for hearing impaired individuals.

During a fire or another hazardous condition, the occupants of a building may only have a few minutes to escape without harm. Due to the potentially limited escape time, it is imperative to provide ample warning to the occupants of a building when a hazardous condition is detected. Most detector and alarm devices rely on audible alarms to alert the occupants in a residential or commercial building. Hearing-impaired persons may experience difficulty in recognizing the warning of a hazardous condition from a conventional alarm. For example, they might not hear an alarm or notice other people responding to an alarm and thus fail to become aware of an emergency situation.

In response to this problem, building and fire regulations mandate that public structures include bright, flashing lights, such as strobes for example, to alert individuals with such impairments. The xenon strobe lights used in conventional alarm systems require a high voltage to produce a flash bright enough to meet building regulations, particularly the minimum intensity requirement viewed from the side of an alarm device. In addition, the xenon lamp generates a significant amount of heat during each flash as a result of the high voltage. Therefore, providing such alarm devices throughout all of the required spaces within a building may be difficult and costly. In addition, the reliability of such devices depends on the availability and integrity of the xenon lamps used, both of which, in recent years, have declined.

BRIEF DESCRIPTION OF THE INVENTION

According to one embodiment of the invention, an indicator assembly for a visual life safety alarm is provided including a hollow, generally frustoconical reflector ring having an angled wall. The reflector ring is mounted to a housing of the visual life safety alarm at a first end. A first plurality of light devices is mounted to the housing within a first opening of the first end of the reflector ring. Light from the first plurality of light devices is configured to emit in a generally forwards direction. A second plurality of light devices is mounted to the housing near the angled wall of the reflector ring, on the opposite side of the reflector ring from the first plurality of light devices. Light from the second plurality of light devices is configured to reflect in a generally angled direction from the visual life safety alarm.

According to another embodiment of the invention, an indicator assembly for a visual life safety alarm is provided including a first directing element and a plurality of second directing elements mounted to a housing of the visual life safety alarm at a first end. The first directing element includes a planar surface disposed generally parallel to the housing. Each of the plurality of second directing elements includes a planar surface arranged at an angle to the housing. A first plurality of light devices is mounted to the planar surface of the first directing element. Light from the first plurality of light devices is configured to emit in a generally forwards direction. A second plurality of light devices is mounted to the planar surfaces of the plurality of second directing elements. Light from the second plurality of light devices is configured to emit in a direction at an angle from the visual life safety alarm.

According to yet another embodiment of the invention, a visual life safety alarm is provided including a housing having a first surface. An indicator assembly is mounted to a central portion of the first surface. The indicator assembly includes a hollow, generally frustoconical reflector ring having an angled wall. The reflector ring is mounted to the first surface of the housing at a first end. A first plurality of light devices is mounted to the first surface of the housing within a first opening of the first end of the reflector ring. Light from the first plurality of light devices is configured to emit in a generally forwards direction. A second plurality of light devices is mounted to the first surface of the housing near the angled wall of the reflector ring, on the opposite side of the reflector ring from the first plurality of light devices. Light from the second plurality of light devices is configured to reflect from the angled wall in a generally angled direction from the visual safety alarm.

According to yet another embodiment of the invention, a visual life safety alarm is provided including a housing having a first surface. An indicator assembly is mounted to a central portion of the first surface. The indicator assembly includes a plurality of directing elements mounted to the first surface of the housing at a first end. Each directing element includes a planar surface. The planar surface of at least a portion of the plurality of directing elements is arranged at an angle to the first surface of the housing. A first plurality of light device is mounted generally parallel to the first surface of the housing. Light from the first plurality of light devices is configured to emit in a generally forwards direction. A second plurality of light devices is mounted to the planar surfaces arranged at an angle to the first surface of the housing. Light from the second plurality of light devices is configured to emit in a generally angled direction from the visual life safety alarm.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
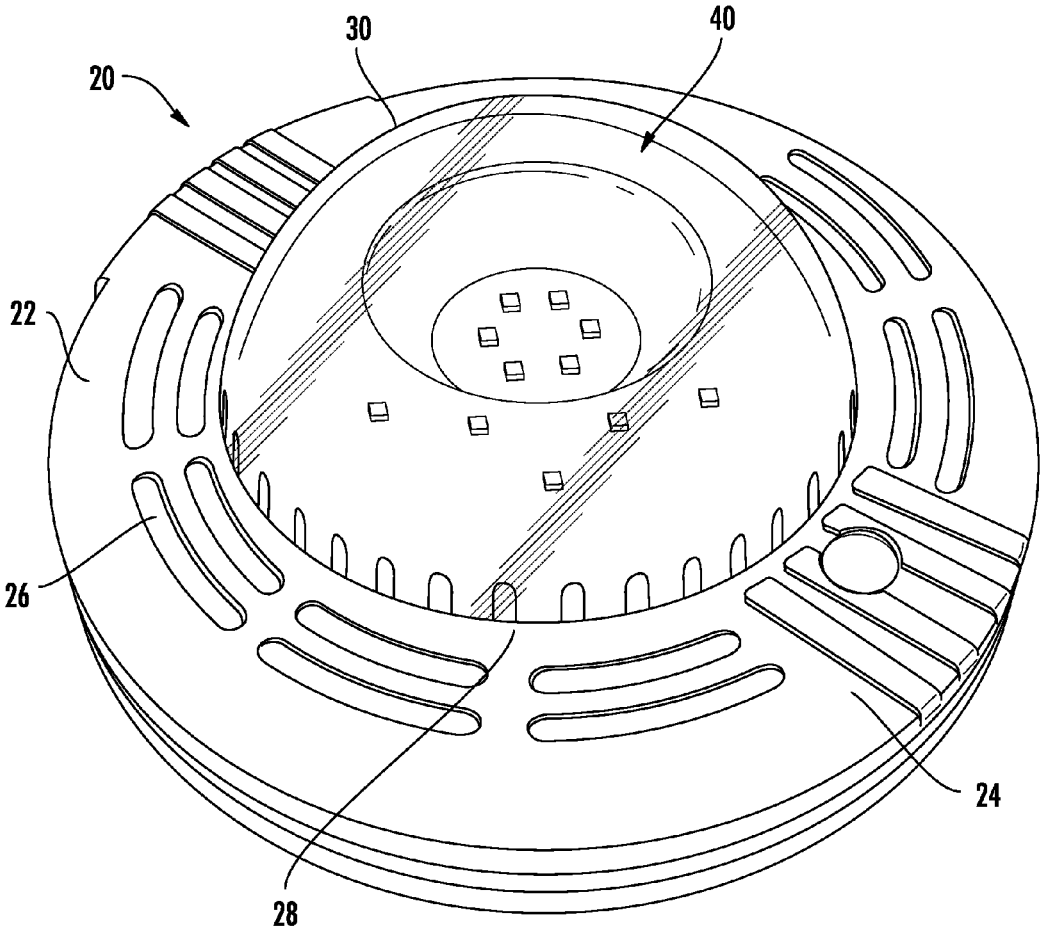
FIG. 1 is a perspective view of a visual life safety alarm according to an embodiment of the invention.

Referring now to the FIGS. a visual life safety alarm 20 is illustrated. The visual life safety alarm 20 includes a housing 22, for example formed from an injection molded plastic. Though the illustrated housing 22 is a generally hollow cylinder, a housing 22 of any shape is within the scope of the invention. Mounted to a first surface 24 of the housing 22 is an indicator assembly 40. In one embodiment, the first surface 24 of the housing 22 includes a plurality of openings 26 such that the indicator assembly 40 is arranged generally at a central portion 28 of the housing 22, having a diameter generally between about two and three inches. A generally transparent cover 30, such as a dome for example, may be configured to surround the indicator assembly 40 and connect to the center 28 of the housing 22.

Figure 2:
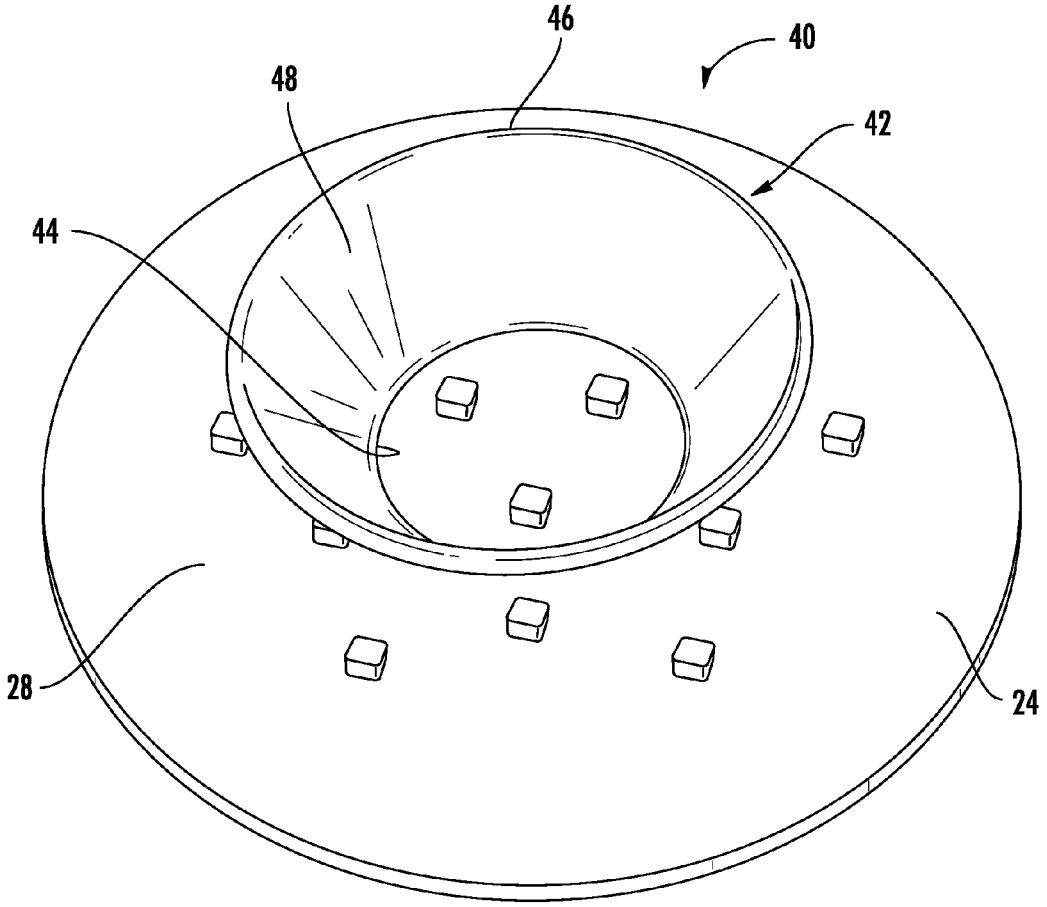
FIG. 2 is a perspective view of an indicator assembly of a visual life safety alarm according to an embodiment of the invention.
Figure 3:
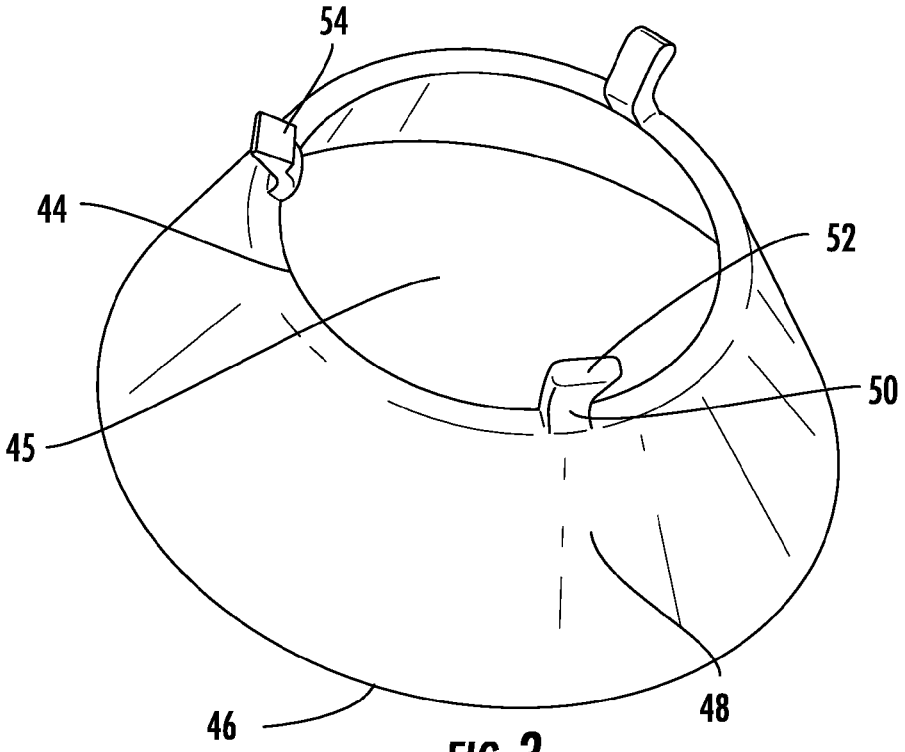
FIG. 3 is a perspective top view of a reflector ring of a visual life safety alarm according to an embodiment of the invention.
Figure 4:
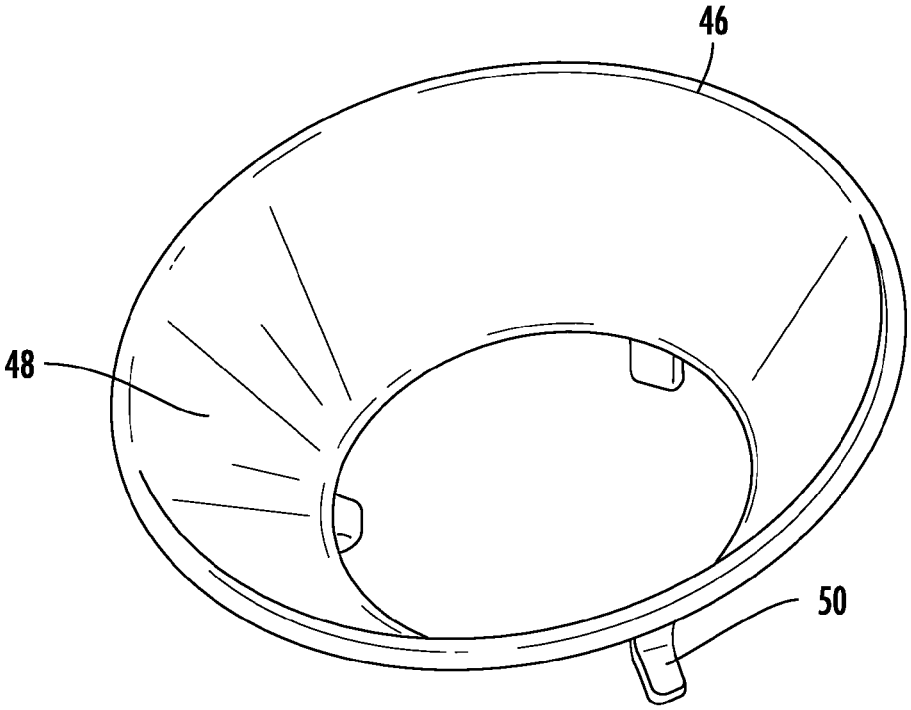
FIG. 4 is a perspective bottom view of a reflector ring of a visual life safety alarm according to an embodiment of the invention.
Figure 5:
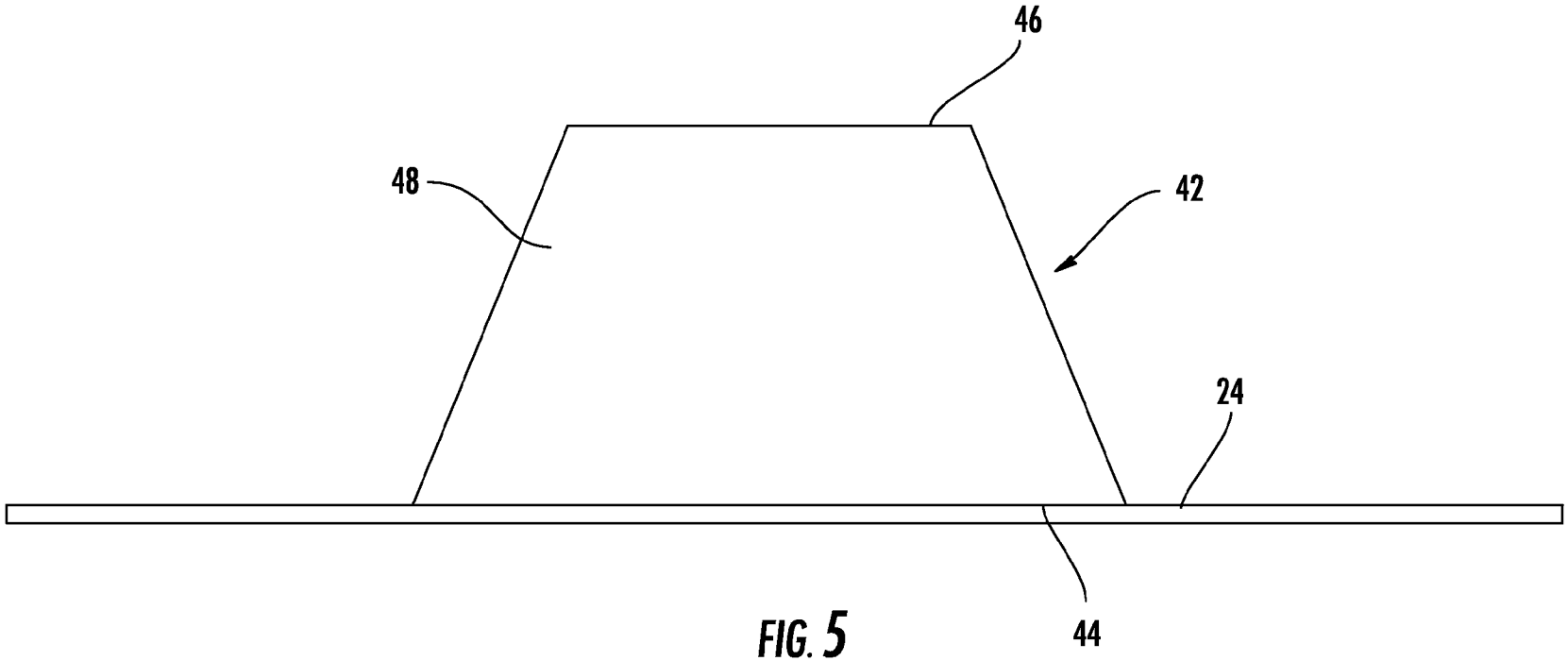
FIG. 5 is a side view of an indicator assembly of a visual life safety alarm according to an embodiment of the invention.

Referring now to FIGS. 2-7, the indicator assembly 40 of the alarm 20 is illustrated in more detail. The indicator assembly 40 includes one or more hollow, substantially frustoconical reflector rings 42 (see also FIGS. 3 and 4) a plurality of light devices 60, such as light emitting diodes (LEDs) for example. The reflector rings 42 are formed from a metal, glass, or plastic material, and a coating, such as paint for example, may be applied to one or more surfaces of the reflector rings 42 to improve the reflectivity thereof. The reflector rings 42 may be permanently or removably mounted to the housing 22 such that a first end 44 of each reflector ring 42 is adjacent the first surface 24 of the housing 22. In one non-limiting embodiment, as shown in FIGS. 3 and 4, a plurality of legs 50 extend from the first end 44 of the reflector ring 42 through a plurality of complementary holes 32 (shown in FIG. 6) formed in the first surface 24 of the housing 22. A protrusion 54 may be arranged at a distal end 52 of each leg 50 is configured to engage a portion of the housing 22, thereby creating a snap-fit connection between the reflector ring 42 and the housing 22.

Figure 6:
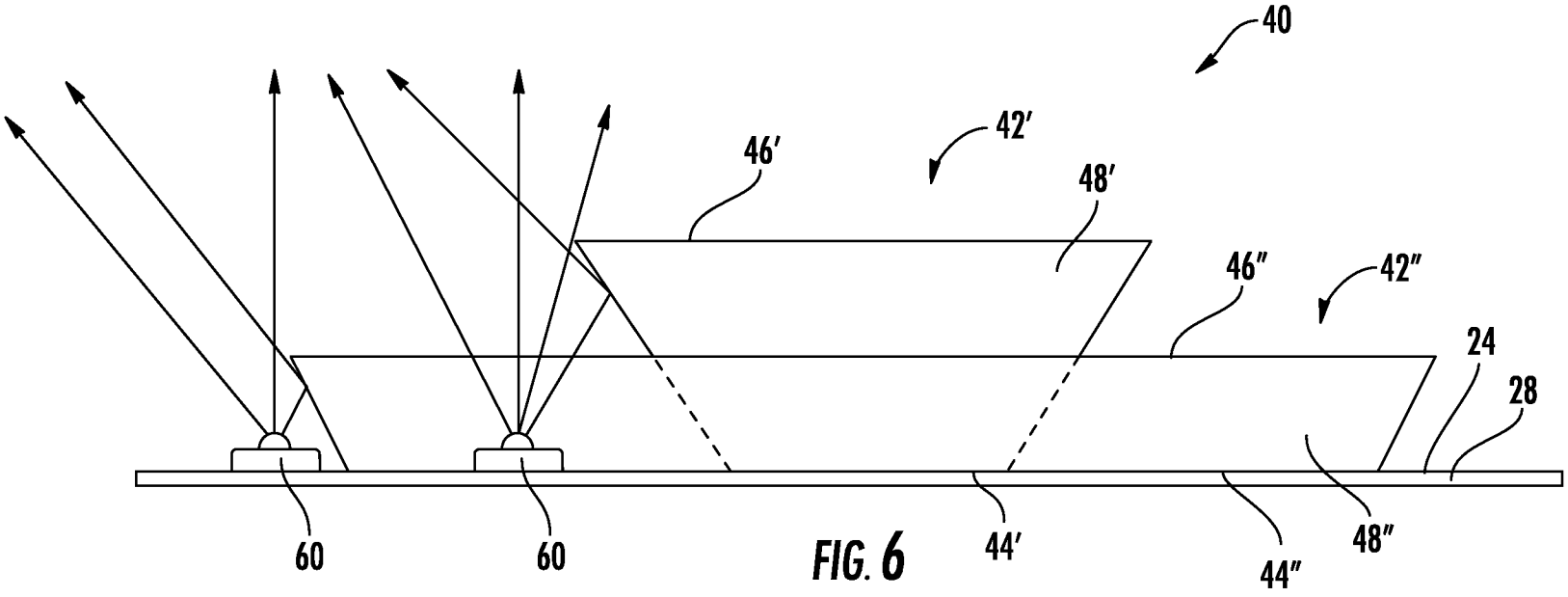
FIG. 6 is a side view of another indicator assembly of a visual life safety alarm according to an embodiment of the invention.
Figure 7:
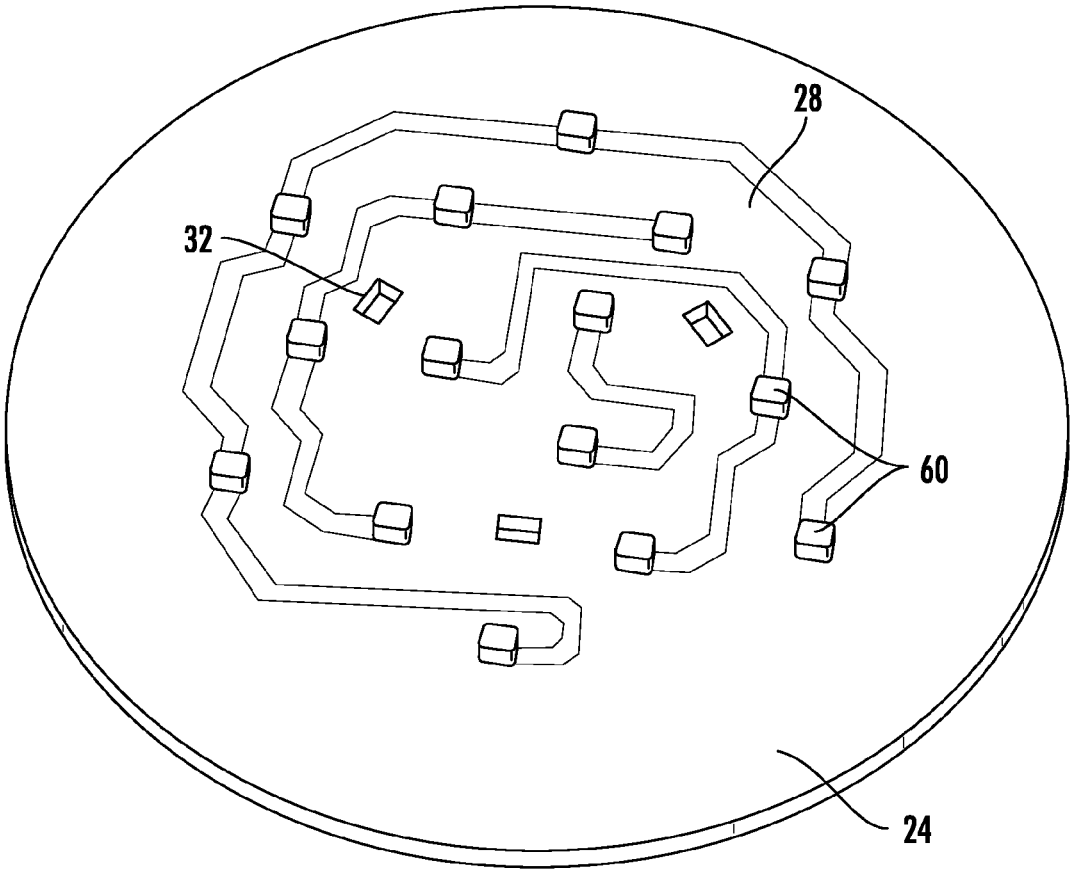
FIG. 7 is a perspective view of a first surface of a visual life safety alarm having a plurality of light devices mounted thereto according to an embodiment of the invention.

The reflector rings 42 are arranged generally concentrically, however, each of the reflector rings 42 may be arranged at any orientation relative to the housing 22. For example, the reflector ring 42 illustrated in FIG. 2 is arranged such that the diameter of the first end 44 of the reflector ring 42 adjacent the first surface 24 is smaller than the diameter of the second end 46 of the reflector ring 42. In other embodiments, the diameter of the first end 44 of the reflector ring 42 adjacent the first surface 24 may be equal to or larger than the diameter of the second end 46 of the reflector ring 42 (see FIG. 5). When the indicator assembly 40 includes more than one reflector ring 42, as shown in FIG. 6, the orientation of the plurality of reflector rings 42 may be generally similar or different. As shown in the non-limiting embodiment of FIG. 6, the second end 46', 46" of each of the first reflector ring 42' and the second reflector ring 42" has a larger diameter than the first end 44', 44" of the respective reflector rings 42', 42". The angled wall 48 of each reflector ring 42 may be arranged at any angle relative to the first surface 24 of the housing 22. In embodiments having more than one reflector ring 42, the angled wall 48 of each reflector ring 42 may be arranged at similar or different angles. In addition, the angled wall 48 of each reflector ring 42 may have a generally smooth contour about its circumference.

Figure 8:
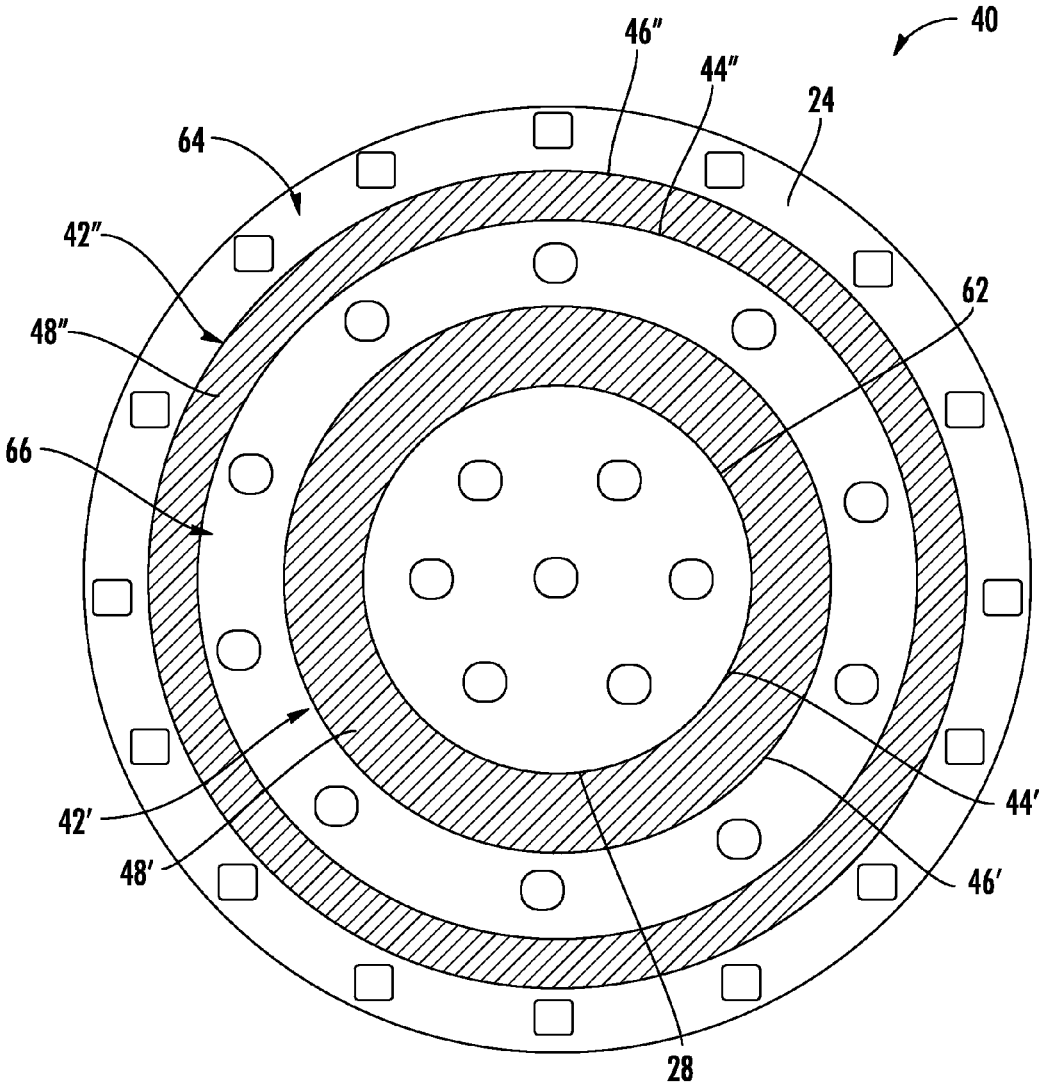
FIG. 8 is a top view of an indicator assembly of a visual life safety alarm according to an embodiment of the invention.

As illustrated in FIG. 8, the plurality of light devices 60 of the indicator assembly 40 may be arranged in groups within the plane of the first surface 24 of the housing 22. For example, a first plurality of light devices 62 may be arranged at the center 28 of the housing 22, within the opening 45 at the first end 44 of a reflector ring 42. In one embodiment, the first plurality of light devices are configured to emit light generally forwards the housing 22, substantially perpendicular to the first surface 24. Another plurality of light devices 64 may be positioned on the first surface 24 between the first end 44 of a reflector ring 42 and the openings 26 in the housing 22. In embodiments including more than one reflector ring 42, another plurality of light devices 66 may be positioned on the first surface 24 of the housing 22 between the first ends 44 of adjacent reflector rings 42. Light emitted from either the plurality of light devices 64 or the other plurality of light devices 66 will reflect from a surface of an adjacent reflector ring 42 to the side of the visual life safety alarm 20.

Figure 9:
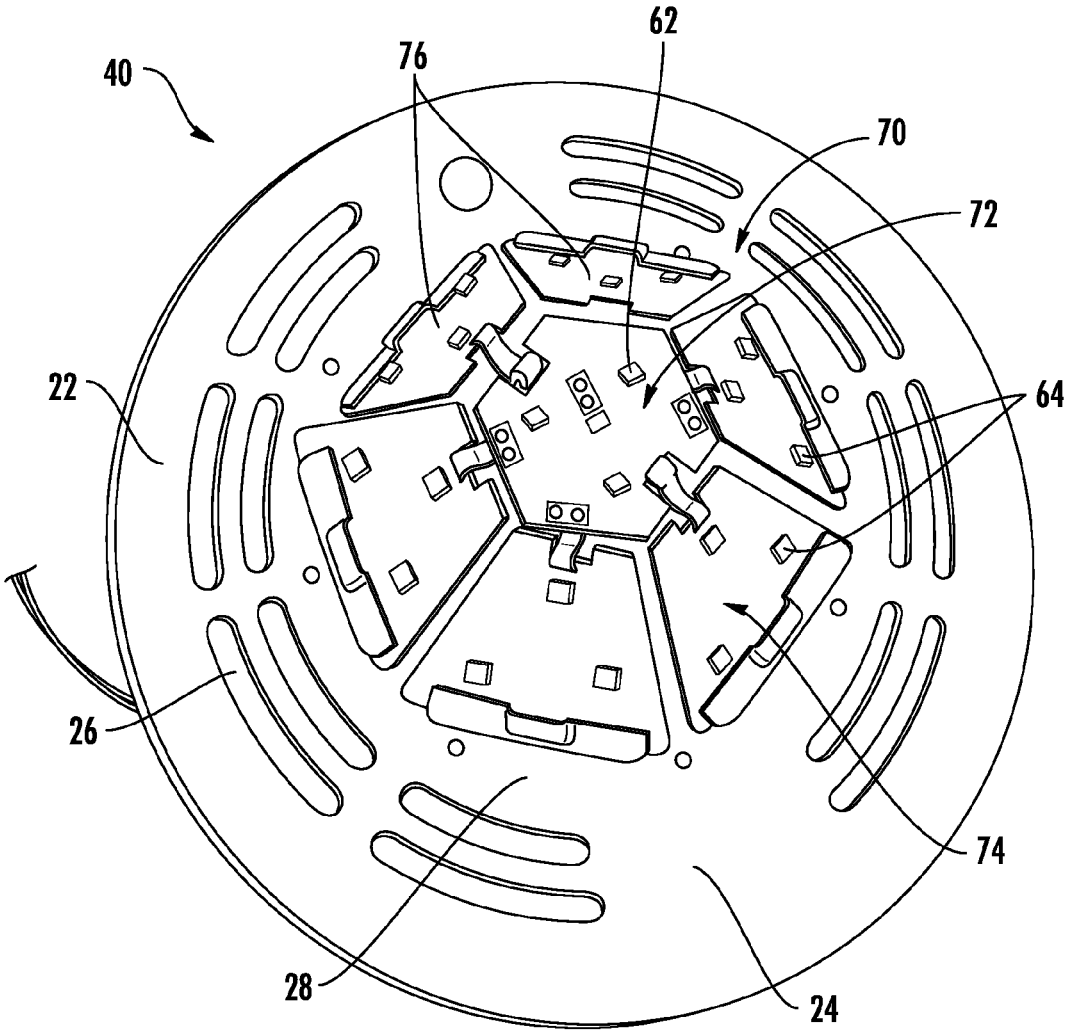
FIG. 9 is a perspective view of an indicator assembly including a plurality of directing elements, according to another embodiment of the invention.

In another embodiment, illustrated in FIG. 9, the indicator assembly 40 includes a plurality of directing elements 70 mounted to the plane of the first surface 24 of the housing 22 at a first end. In one embodiment, the plurality of directing elements 70 includes a first directing element 72 and a plurality of second directing elements 74. A planar surface 76 of the first directing element 72 is arranged generally parallel to the first surface 24 of the housing 22, and a planar surface 76 of each of the plurality of second directing elements 74 is arranged generally at an angle to the first surface 24 of the housing 22. The plurality of second directing elements 74 may be arranged at an angle to one another such that the directing elements 70 are positioned generally in a circle about the central portion 28 of the housing 22. The directing elements 70 may be formed individually, or alternatively, may be integrally formed.

An indicator assembly 40 having at least one directing element 70 includes a plurality of light devices 60 mounted to the planar surface 76 of each directing element 70. The direction in which light is emitted by a light device 60 mounted to a directing element 70 is determined by the position and angle of the planar surface 76 relative to the first surface 24 of the housing 22. For example, a first plurality of light devices 62 mounted to the planar surface 76 of the first directing element 72 are configured to emit light generally forwards from the housing 22. A second plurality of light devices 64 are generally mounted to the planar surfaces 76 of the plurality of second directing elements 74. By arranging the plurality of second directing elements 74 generally in a circle, light may be emitted generally at an angle, from the sides of the indicator assembly 40 about the circumference of the visual life safety alarm 20.

Figure 10:
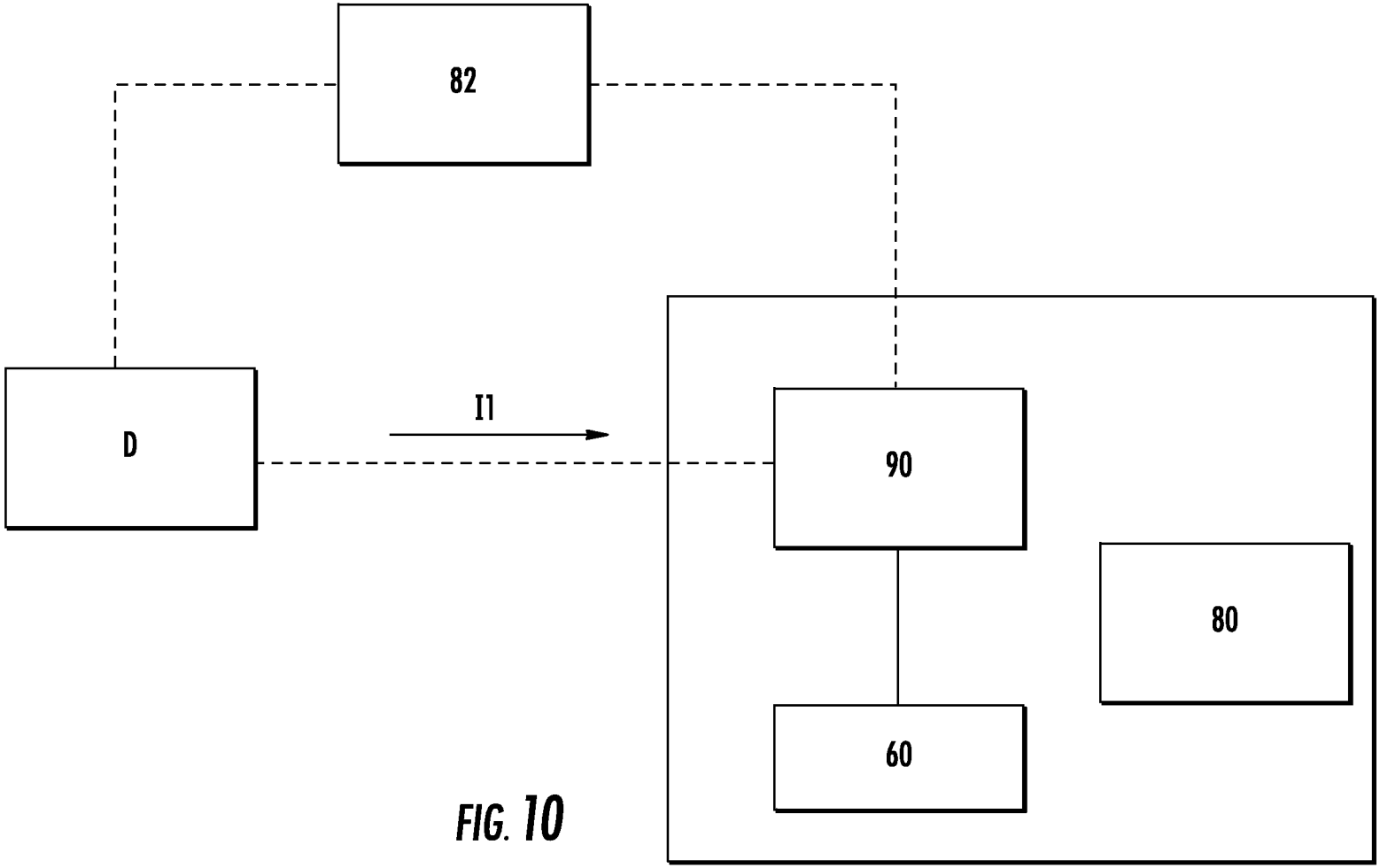
FIG. 10 is a schematic diagram of a controller of the visual life safety alarm according to an embodiment of the invention.

Turning now to FIG. 10, which is a schematic diagram of the control system of the alarm device 10, positioned within the housing 22 may be a first power source 80, such as a battery for example, and a controller 90 configured to operate the plurality of light devices 60 of the indicator assembly 40. In one embodiment, the visual life safety alarm 20 may be hard wired to a second power source 82, and the first power source 80 may only be used as a backup during a loss of power event. The controller 90 of the visual life safety alarm 20 may be operably coupled to one or more detectors, illustrated schematically at D, configured to detect any of a number of hazardous conditions including, but not limited to, fire, smoke, and carbon monoxide. When a detector D perceives a hazardous condition, an input signal I1 is provided to the controller 90 of the visual life safety alarm 20. Based on the input signal I1 received, the controller 90 operates the plurality of light devices 60 in a predetermined pattern, for example a given number of flashes followed by a pause, to indicate the presence of a given hazardous condition. In one embodiment, a unique pattern associated with the input signal I1 of each detectable hazardous condition is stored within the controller 90. Some of the light from the plurality of light devices 60 is emitted in a generally forwards direction and some of the emitted light reflects off the one or more reflective rings 42 such that an intense light is projected from both the sides and the front of the visual life safety alarm 20.

The intensity of the light projected from the sides of the visual life safety alarm 20 may be controlled by adjusting the angle and orientation of the directing elements 70 or reflector rings 42 as well as the placement of the light devices 60 relative to the directing elements 70 or reflector rings 42. Inclusion of at least one directing element 70 or reflector ring 42 allows the light emitted by the light devices 60 to emit at more angles and therefore have a better distribution and more uniform intensity than light devices alone. In addition, use of a plurality of light emitting diodes 60 instead of the conventional xenon flash lamp in the visual life safety alarm 20, reduces the material and manufacturing costs of the alarm, as well as the risks associated therewith.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An indicator assembly for a visual life safety alarm, comprising:

a hollow, generally frustoconical first reflector ring having an angled wall extending from a first end to a second, opposite end, the first reflector ring being mounted to a housing at the first end;

a hollow, generally frustoconical second reflector ring having an angled wall extending from a first end to a second, opposite end, the second reflector ring being mounted to the housing at the first end, the first reflector ring and the second reflector ring being arranged generally concentrically;

a first plurality of light devices mounted to the housing within a first opening of the first end of the first ring, wherein light from the first plurality of light devices is configured to emit in a generally forwards direction; and a second plurality of light devices mounted to the housing near the angled wall of at least one of the first reflector ring and the second reflector ring wherein light from the second plurality of light devices is configured to reflect from the angled wall in a generally angled direction from the visual life safety alarm.

2. The indicator assembly according to claim 1, wherein an angled wall of the reflector ring has a generally smooth contour.

3. The indicator assembly according to claim 2, wherein the first plurality of light devices and the second plurality of light devices are arranged in a plane including the first end of the reflector ring.

4. The indicator assembly according to claim 1, wherein the first plurality of light devices and the second plurality of light devices include light emitting diodes.

5. The indicator assembly according to claim 1, wherein a diameter of the second end of the reflector ring is larger than a diameter of the first end of the reflector ring.

6. The visual life safety alarm according to claim 1, wherein the first end of the reflector ring is configured to couple to the housing through a snap fit connection.

7. The visual life safety alarm according to claim 6, wherein the first end of the reflector ring includes a plurality of legs, each leg having a protrusion arranged at a distal end thereof and being configured to extend through a plurality of complementary holes arranged in the housing.

8. A visual life safety alarm, comprising:

a housing having a first surface;

an indicator assembly mounted to a central portion of the first surface, the indicator assembly including:

a hollow, generally frustoconical first reflector ring having an angled wall, the first reflector ring being mounted to the first surface of the housing at a first end;

a hollow, generally frustoconical second reflector ring having an angled wall, the second reflector ring being mounted to the first surface of the housing at the first end, the first reflector ring and the second reflector ring being arranged generally concentrically;

a first plurality of light devices mounted to the first surface of the housing within a first opening of the first end of the first reflector ring, wherein light from the first plurality of light devices is configured to emit in a generally forwards direction; and a second plurality of light devices mounted to the first surface of the housing near the angled wall of at least one of the first reflector ring and the second reflector ring, wherein light from the second plurality of light devices is configured to reflect from the angled wall to a side of the visual life safety alarm.

9. The visual life safety alarm according to claim 8, further comprising:

a controller coupled to the first plurality of light devices and the second plurality of light devices, the controller being configured to operate the first plurality of light devices and the second plurality of light devices in a predetermined pattern when a hazardous condition is detected.

10. The visual life safety alarm according to claim 9, wherein a plurality of predetermined patterns are stored within the controller, each pattern being associated with a different hazardous condition.

11. The visual life safety alarm according to claim 9, further comprising a power source arranged within the housing and operably coupled to the controller.

* * * * *